US006105633A

United States Patent [19]

Pedersen et al.

[11] Patent Number: 6,105,633

[45] Date of Patent: Aug. 22, 2000

[54] LIQUID DISPENSER

[75] Inventors: Daniel E. Pedersen, Cottage Grove; Mark J. Toetschinger, Mendota Heights, both of Minn.

[73] Assignee: Ecolab Inc., St. Paul, Minn.

[21] Appl. No.: 09/347,120

[22] Filed: Jul. 2, 1999

[51] Int. Cl.[7] ..... B65B 1/04

[52] U.S. Cl. ..... 141/18; 141/373; 141/367; 141/360

[58] Field of Search ..... 141/2, 9, 18, 100, 141/369–373, 367, 386, 378, 351, 360

[56] References Cited

U.S. PATENT DOCUMENTS 5,651,398 7/1997 Decker et al. ..... 141/18
5,896,898 4/1999 Crossdale et al. ..... 141/360
6,003,569 12/1999 Williams ..... 141/362

*Primary Examiner*—Steven O. Douglas
*Attorney, Agent, or Firm*—Mau & Krull, P.A.

[57] ABSTRACT

A dispensing apparatus (200) dilutes a liquid concentrate to form a dilute use solution for dispensing into a bottle having first and second lockout sections. The dispenser (200) includes an aspirator (222) and a valve (210) operatively connected to the aspirator (222) to control flow of liquid diluent. A base member is positioned under the aspirator (222) and has first and second sides (206 and 207). Each side has an inwardly protruding lockout member (249 and 250). The bottle (201) has elongate lockouts (245 and 246) and vertical lockouts (247 and 248). The lockouts provide for a lockout to prevent the wrong bottle from entering the dispenser (200) and also provides for alignment of the bottle (201) as it is moved vertically towards the aspirator (222).

16 Claims, 5 Drawing Sheets

217
210
234a
216
235b
212
216b
215
216a
205
231
235
235c
230
222
235a
226
227
235e
235d
237
238
246
249
252
248
208c
208h
209

FIG. 5
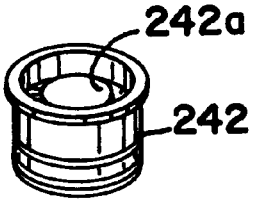
FIG. 6
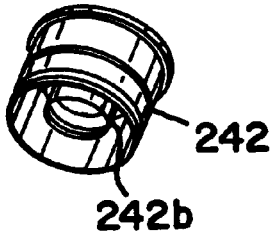
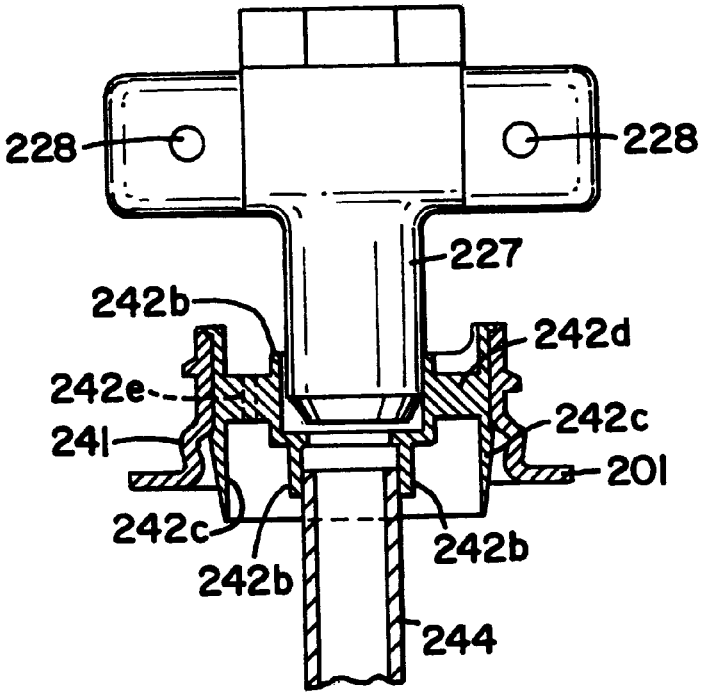
FIG. 7

LIQUID DISPENSER

FIELD OF THE INVENTION

This invention relates generally to a dilution dispenser and more particularly to a dilution dispenser and bottle which has a two-directional lockout feature as well as an additional lockout feature based on the shape of the base of the bottle.

DESCRIPTION OF THE BACKGROUND OF THE INVENTION

Dilution apparatus using an aspirator, to dilute a liquid concentrate with a liquid diluent to form a use solution, have been used for many years. The first such systems were ad hoc. Loose assemblies of tubing, connections, aspirators, etc. The typical prior art diluting station comprises a large reservoir of concentrate, a source of diluent, typical service water, and a receiving container for the dilute use solution. Such a dilution apparatus is operated by passing service water or other aqueous stream through the aspirator containing a venturi. A venturi draws the liquid concentrate from the bulk into contact with the aqueous diluent stream, mixes the diluent and concentrate forming a use solution which is then transferred to a use solution container. The configuration of such a dilution apparatus has taken a large variety of embodiments. Large numbers of embodiments of concentrate containers, transfer mechanism, aspirator control means, use solution containers and various combinations of these elements have been attempted in the past.

In the past, the known prior art dilution systems have a hose or conduit at the end of the venturi for the dispensing of the use solution. This conduit is simply placed inside of the bottle or container to receive the use solution. When a plurality of dispensers are used, for a plurality of chemicals, there is no control or mechanism to prevent a first chemical being placed in a bottle which was designed and labeled for a second chemical.

Still further, when activating the dispenser, it is often necessary to place the conduit in the bottle and then, with the other hand, activate the dispenser. There are prior art dispensers which are activated by means of pressing the bottle backward in the same direction as is necessary to push the switch which activates the dispenser. However, it is often more convenient from a design point to have the activation button move in one direction and the movement of the bottle in another direction. However, under prior art devices, it is not possible to have the movement of the bottle in one direction activate the switch in another direction.

The dispenser disclosed in U.S. Pat. No. 5,832,972 addresses the problems noted above with respect to the prior art and provides for a dispenser wherein a simple movement of the bottle in one direction into the diluting apparatus will activate a switch, which moves in a second direction, to begin the dispensing of the solution into the bottle. Such a dispensing apparatus utilized bottles that were filled with a tube from the dispenser. The tube typically went to the bottom of the bottle. However, such a dispenser is not satisfactory where the bottle includes a self-contained dip tube. In such instances, the tube from the dispenser would not fit into the bottle. In certain applications, where it is desired to use a bottle with a dip tube, there is presently no dispenser which adequately fills the bottle and performs the necessary lockout features to prevent the dispensing of the wrong chemical into a wrong bottle.

Accordingly, the present invention provides for a two-directional lockout feature on the bottle as well as another lockout feature to make certain that the correct chemical is dispensed into the proper bottle for subsequent use.

SUMMARY OF THE INVENTION

The invention is an apparatus for diluting a liquid concentrate with a liquid diluent to form a dilute solution for dispensing into a bottle having a first lockout section and a second lockout section. The apparatus includes an aspirator having a liquid diluent inlet, an inlet for liquid concentrate and an outlet for a dilute solution. A valve is operatively connected to the aspirator for controlling the flow of liquid diluent from a source of liquid diluent to the aspirator inlet. A base member is positioned under the aspirator outlet, the base having first and second sides. Each side has a mating lockout member. The mating lockout member is sized and configured to correspond with the first lockout section of the bottle and allowing generally horizontal movement of the bottle along the first lockout member. When the bottle is fully inserted into the base member, the mating lockout member allows generally vertical movement along the second lockout section, wherein the lockout member, first lockout section and second lockout section prevent bottles having different lockout sections from entering the base member and providing alignment of the bottle as it is moved vertically toward the aspirator outlet.

The invention is also an apparatus for diluting a liquid concentrate with a liquid diluent to form a dilute solution. The apparatus includes an aspirator having a liquid diluent inlet, an inlet for liquid concentrate and an outlet for a dilute solution. A valve is operatively connected to the aspirator for controlling the flow of liquid diluent from a source of liquid diluent to the aspirator inlet. A bottle has an opening for receiving the dilute solution into its interior cavity, the bottle having a first lockout section and a second lockout section. A base member is positioned under the aspirator outlet, the base having first and second sides. Each side has a mating protruding lockout member. The mating lockout member is sized and configured to correspond with the first lockout section of the bottle and allows generally horizontal movement of the bottle along the first lockout member and, when the bottle is fully inserted into the base member, allows generally vertical movement along the second lockout section. The lockout member, first lockout section and second lockout section prevent bottles having different lockout sections from entering the base member and provides alignment of the bottle as it is moved vertically toward the aspirator outlet.

The invention is also a bottle for use with an apparatus for diluting a liquid concentrate with a liquid diluent to form a dilute solution for dispensing into the bottle. The apparatus has an aspirator having a liquid diluent inlet, and inlet for liquid concentrate and an outlet for a dilute solution. A valve is operatively connected to an aspirator for controlling flow of liquid diluent from a source of liquid diluent to the aspirator inlet. A base member is positioned under the aspirator outlet, the base having first and second sides. Each side has an interior protruding lockout member. The bottle has first and second sidewalls, front, back, top and bottom operatively connected to form a bottle having an interior cavity. An opening is formed in the top for receiving a dilute solution into the inner cavity. A first lockout section on the first sidewall and a second lockout section generally perpendicular to the first lockout section is on the first sidewall. The first and second lockout sections are sized and configured to correspond with the protruding lockout member and allows generally horizontal movement of the bottle along the first lockout section and, when the bottle is fully inserted into the base member, allows generally vertical movement along the second lockout section, wherein the lockout member, first lockout section and second lockout section prevent different bottles having different lockout sections from entering the base member and provides vertical alignment of the bottle as it is moved vertically toward the aspirator outlet.

BRIEF DESCRIPTION OF THE DRAWINGS

FIG. 5 is an exploded perspective view of an insert, viewed generally from above, which goes into the bottle;

FIG. 6 is an exploded perspective view of the insert, as shown in FIG. 5, generally shown from below; and FIG. 7 is a cross-sectional view of the insert shown in FIG. 5 with the nozzle inserted.

DETAILED DESCRIPTION OF THE PREFERRED EMBODIMENT

The apparatus of the invention for diluting a liquid concentrate to a dilute liquid use solution contains an aspirator. Aspirators contain a venturi device driven by water pressure to draw a concentrate. The venturi device comprises a nozzle opening associated with a body of concentrate solution. The velocity of the diluent through the nozzle causes a reduction in pressure, draws the concentrate into the aspirator, generally causing a mixing of the concentrate and diluent typically at a fixed ratio depending on pressure, tubing sizes and length. Once diluted and mixed, the dilute use solution leaves the aspirator through an outlet for the dilute use solution. The outlet is in liquid communication with the use solution container.

The concentrate materials of the invention include general purpose cleaning and sanitizing materials, coating compositions and other useful institutional or industrial liquid concentrates. Such materials include window cleaners, hand soap, hard surface cleaners, floor cleaners, bathroom cleaners, tile cleaners, drain cleaners and drain openers, glass cleaners, cleaners for food preparation units, sanitizers, disinfectants, animal and personal care products, aqueous coating compositions, water reducible concentrates, water reducible floor finishes, aqueous wax dispersions, air fresheners, odor counteractants, and other similar concentrates that can be formed as an aqueous solution, an aqueous alcoholic solution, an aqueous dispersion, an aqueous reducible solution or dispersion, etc.

The liquid concentrate materials useful for dilution to a dilute use solution typically comprise aqueous solutions, aqueous suspensions, aqueous reducible concentrates, aqueous alcoholic concentrates, etc., of cleaning or sanitizing chemicals. The concentrate can contain about 20 to 90 wt. % of active cleaning materials. The typical viscosity of the liquid concentrates typically ranges from about 1 to 500 cP. The chemical systems can comprise a surfactant based cleaner, an antimicrobial, a floor finish, etc. The cleaner can be a generally neutral system, an acid-based system containing compatible surfactant, cosolvents and other additives or alkaline systems containing a source of alkalinity, compatible surfactants, cosolvents, etc.

The apparatus is typically adapted and configured to dilute a variety of liquid concentrates to useful dilute use solutions. The cross contamination should be avoided. Acid cleaners can render basic cleaners inoperative. Further, the addition of a chlorine source to an acid can release inappropriate toxic fumes. A variety of other inappropriate interactions can occur resulting ultimately in a use solution that is not appropriate for its intended purpose.

Figure 3:
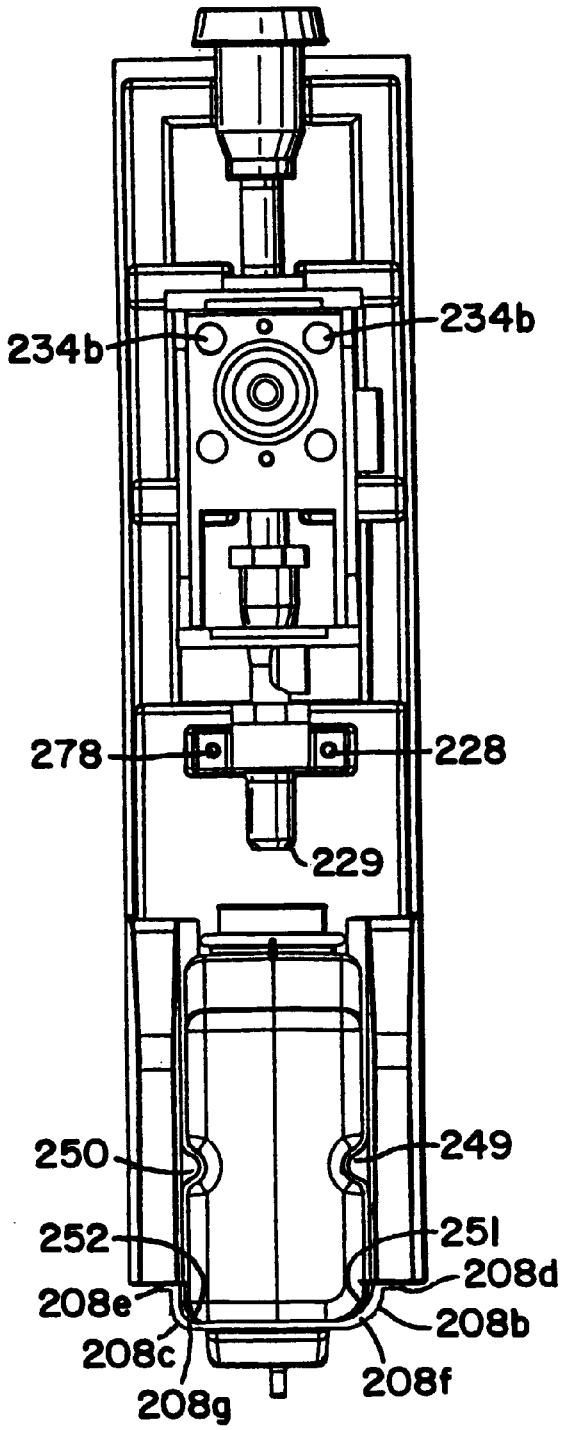
FIG. 3 is a front plan view of the dispenser shown in FIG. 1, with the slide removed for clarity purposes.
Figure 4:
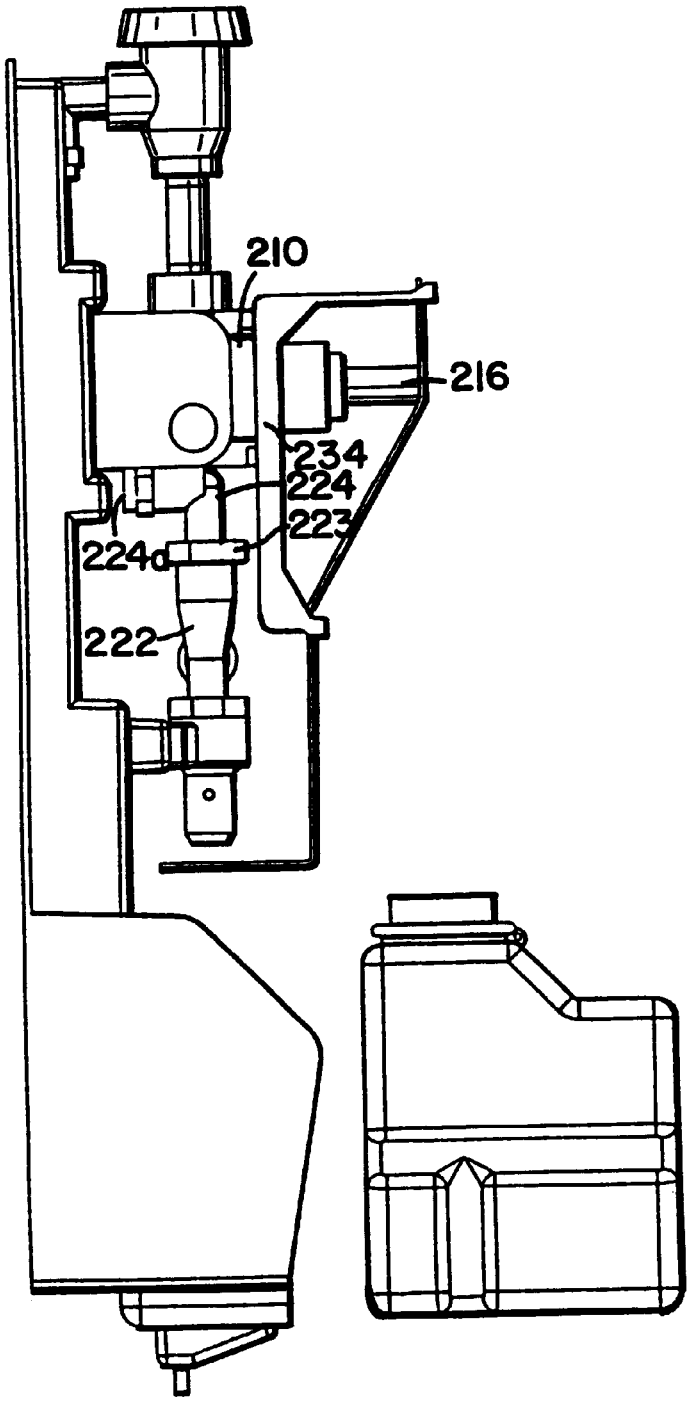
FIG. 4 is a side elevational view of the liquid dispenser shown in FIG. 1.

Referring to the drawing, wherein like numerals represent like parts throughout the several views, there is generally disclosed at 200 an apparatus for diluting a liquid concentrate with a liquid diluent to form a dilute use solution for dispensing into a bottle 201. The dispensing apparatus 200 includes a base 202 which is mounted on a wall or other mounting surface by means well known in the art. A housing (not shown) may also be used to cover the dispensing apparatus 200. Any suitable housing or covering may be utilized such as that shown in U.S. Pat. No. 5,832,972. However, it is appreciated that the geometric lockout in the cover as shown in U.S. Pat. No. 3,832,972 is not necessary for the present invention as will be evident as different lockout provisions are utilized. The base 202 is preferably formed as a single unit and is a molded plastic part. However, the components may be made separately and later assembled. The base 202 has a back wall 203 and upper sides 204 and 205. Lower sides 206 and 207 are formed as continuations of upper sides 204 and 205 respectively. There is a space between the lower sides 206 and 207 which is sized to accommodate the bottle 201 as will be described more fully hereafter. A bottom member 208 has a bottom section 208*a* and first sides 208*b* and 208*c*. The sides 208*b* and 208*c* have flanges 208*d* and 208*e* respectively which are used to secure the sides 208*b* and 208*c* to the lower side 206 and 207 respectively. Any suitable means such as screws (not shown) may be utilized to secure the bottom member to the base 202. Optimally bottom member 208 may be molded as integral parts of lower sides 206 and 207. Screw openings are shown in FIG. 3. The first side 208*b* has an inner radius 208*f* which is of a different geometric shape and is more rounded than the radius 208*g* of the second side 208*c*. As will be described more fully hereafter, the different radiuses form a secondary lockout to prevent the wrong bottle 201 from being inserted into the dispensing apparatus 200.

The bottom section 208*a* has a depressed area 208*h* which forms a drain and a drain tube 209 is in fluid communication with the depressed area 208*h* to drain any spilled liquid. A suitable tube (not shown) is connected to the drain tube 209 to dispose of any spilled liquid.

A controller or valve 210 is mounted to the base by suitable means, such as screws (not shown). The valve 210 has a right sidewall 211 and a left sidewall 212. The sidewalls 211 and 212 have flanges which may accept the screws to secure the valve to the base 202. The valve 210 has a valve body 213 which has an inlet 214 through which a suitable diluent source, such as water, is provided. A pipe plug 215 is located on the opposite side of the valve body as the inlet 214. The inlet 214 is sized and configured to accept a connector which in turn connects to a diluent inlet hose. Mounted to the valve body 213 is an activation switch 216. The activation switch 216 includes a body 216*a* and a depressible push button 216*b*. The button 216*b* is mounted in the body 216*a* with a spring which biases the button away from the valve body to an off position. The valve body 210 has a threaded outlet 217. The valve 50 may be any suitable valve such as Model No. 633B valve assembly made by Dema Engineering of St. Louis, Mo.

The threaded outlet 217 is connected via a pipe 218 to a back flow prevention unit 219. The back flow prevention unit 219 has an exit 220 which is connected to an inlet 221*a* of an elbow 221. The elbow 221 has an exit 221*b* which is connected via a hose (not shown) to an aspirator 222. The aspirator 222 may be any suitable model such as the No. 440200 made by Hydro Systems of Cincinnati, Ohio. The aspirator 222 has an inlet 223. The inlet 223 is connected to an elbow 224 which has an inlet 224*a*. It is the inlet 224*a* which is connected via the hose to the outlet 221*b*. The aspirator 222 includes a venturi. An inlet to the venturi is provided through opening 225. Opening 225 is adapted and configured to accept metering tip which is in turn connected to a tube which is in turn in fluid communication with the liquid to be dispensed. The metering tip is readily changeable to change the concentration of the use solution which comes out of the aspirator 222. The aspirator 222 has an outlet 226 which is in fluid communication with a dispensing nozzle 227. The nozzle has two flanges through which screws 228 are inserted to connect the nozzle 227 to the base 202. The nozzle has a tapered tip 229. The nozzle has a longitudinal bore throughout so as to dispense the use solution.

An activation mechanism, similar to that shown in U.S. Pat. No. 5,832,972 is utilized. The liquid dispenser 200 includes a bracket 230 which is secured to the valve body 213 through two screws (not shown) through openings 231. The bracket 230 has a first side member 232 connected to a second side member 233 by an intermediate member 234. The first side member 232 has a rectangular slot 232*a* and the second side member 233 has a rectangular slot 233*a*. The intermediate member 234 has an aperture 234*a* through which the switch body 216*a* is inserted. Also provided are access holes 234*b*. The access holes 234*b* allow access in order to tighten the screws which connect the controller 210 to the base 202. The rectangular slot 232*a* is placed closer to the intermediate member 234 than the rectangular slot 233*a*.

Figure 1:
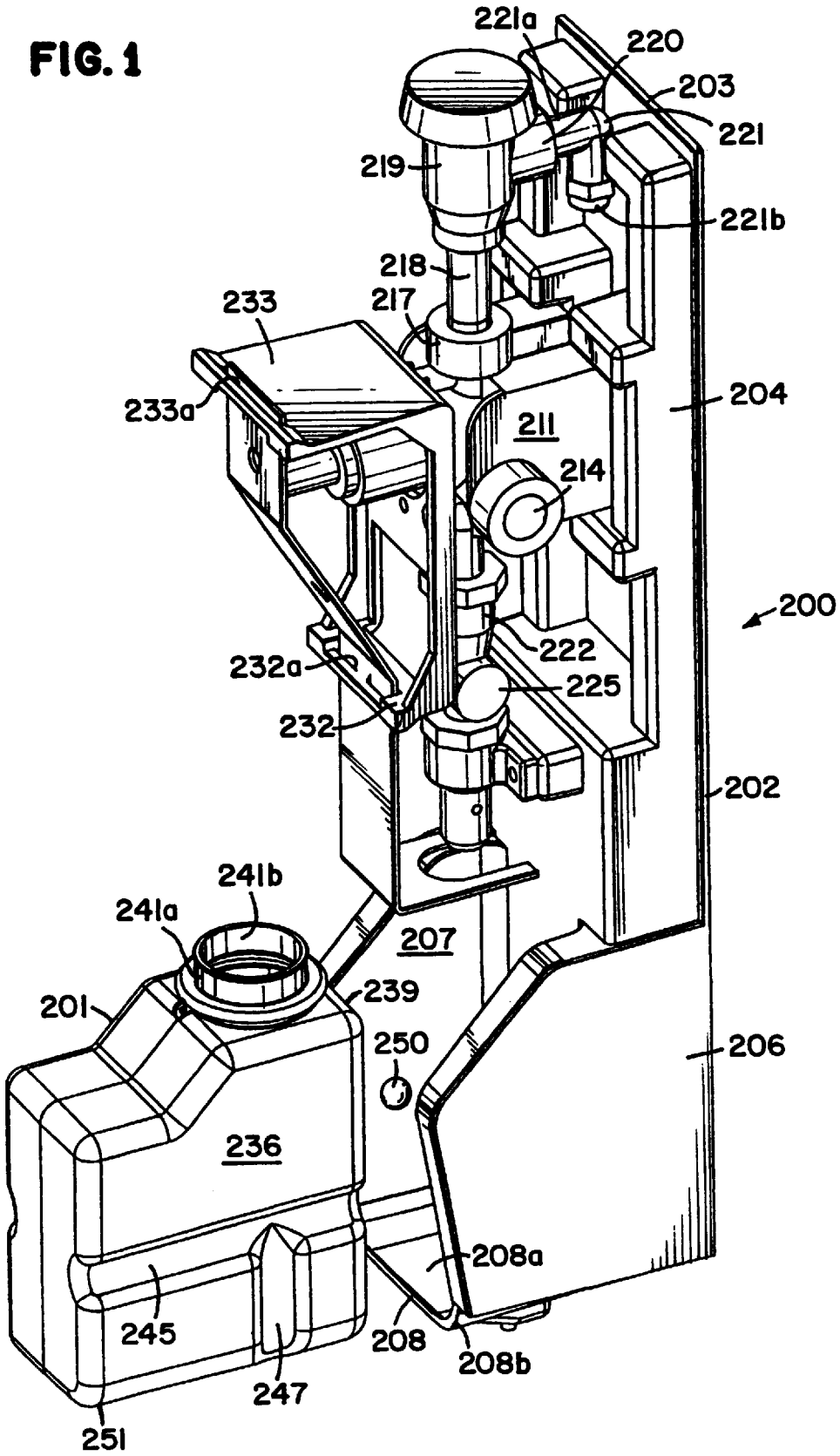
FIG. 1 is a perspective view of the liquid dispenser of the present invention shown generally from above and to the right.
Figure 2:
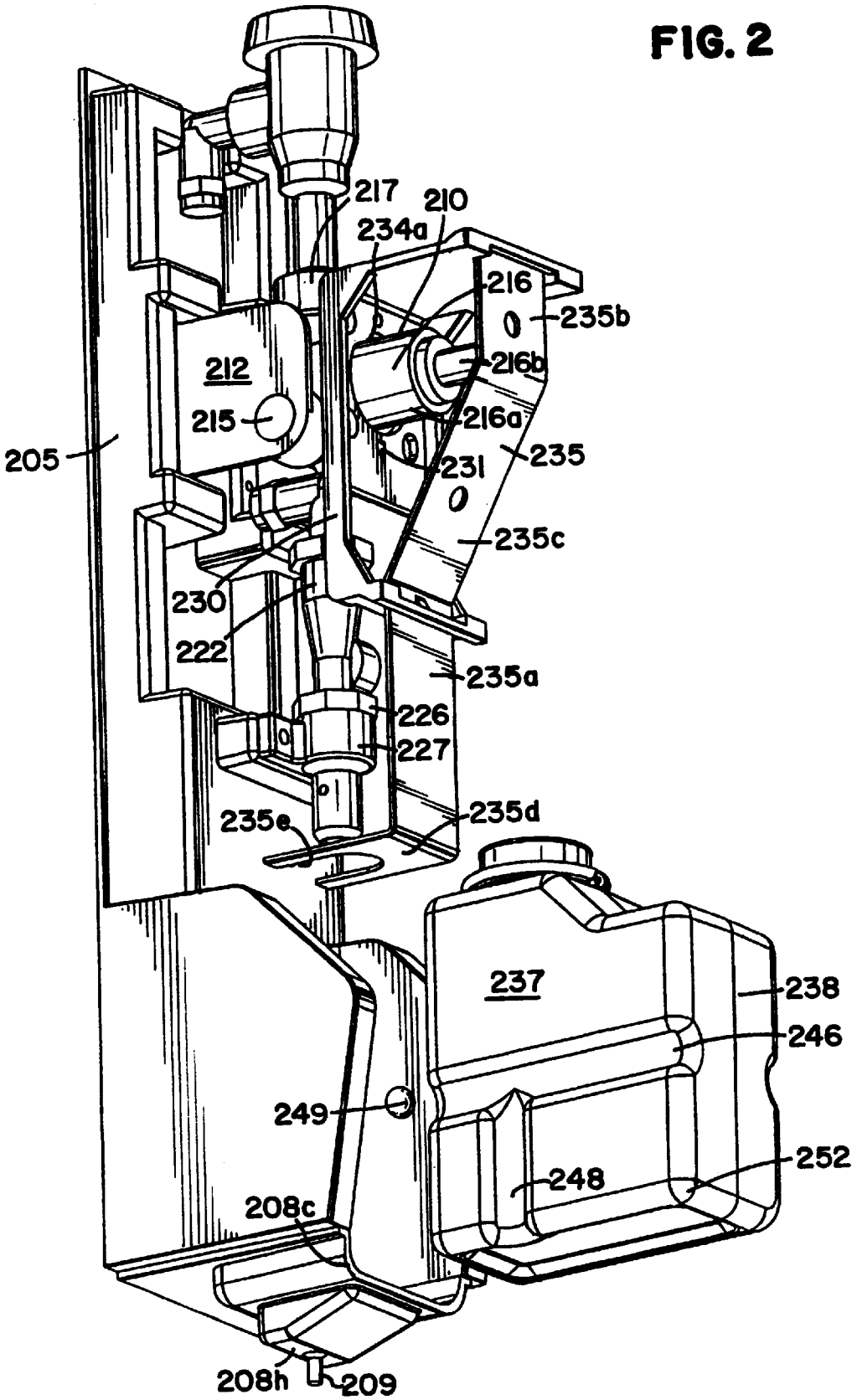
FIG. 2 is a perspective view of the liquid dispenser shown in FIG. 1, viewed generally from below and the left.

A slide actuator 235 has a first portion 235*a* connecting a second portion 235*b* by an angled (or inclined) intermediate portion 235*c*. At the first portion 235*a*, is a downwardly depending member 235*d*. This member 235*d* has a slot 235*e* through which the dispensing nozzle 227 may pass as the slide actuator is moved upward. The first portion 235*a* is inserted through the rectangular slot 232*a* and the second portion 235*b* is inserted into the slot 233*a*. The bracket 230 is typically made of plastic and is therefore deformable to allow the second portion 235 to be inserted into the rectangular slot 233*a*. A bottle 201 is typically 16 ounces and preferably between 8 and 32 ounces. The bottle may be any suitable model such as a blow-molded plastic. The bottle 201 has a right side 236, left side 237, back 238, front 239, bottom 240 and top 241 all operatively connected to form a bottle having an inner cavity for receiving a dilute use solution. The top 241 has a neck portion 241*a* which has an opening 241*b*. An insert 242 is positioned inside of the opening 241*b*. The bottle 201, shown in FIG. 1, does not have the insert shown. However, the insert, as shown in FIGS. 5 through 7 is inserted into the opening 241*a* and secured by suitable means, either a force fit, or if nonremovability is preferred, it is secured by a method such as spin welding, heat welding or bonding. The insert 242 has central portion 242*b* with a bore 242*a* extending therethrough. A central portion 242*b* forms a cylindrical portion in which the nozzle 227 is inserted. An outer cylindrical portion 242*c* is connected to the inner cylindrical portion 242*b* by a ring 242*d*. One or more vent holes 242*e* are formed in the ring portion 242*d*. Therefore, air is able to vent between the interior of the bottle 201 and the atmosphere. A dip tube 244 is connected to cylindrical portion 242*b*. As can be seen in FIG. 7, the cylindrical portion 242*b* has an upper section that has a diameter which is greater than the lower section. However, the bore 242*a* extends throughout the portion 242*b*. In FIG. 7, the dip tube 244 is shown broken away, but preferably the dip tube 244 extends down to the bottom of the bottle 201.

The bottle 201 has a first elongate lockout 245 on the right side 236 and a similar lockout 246 formed in the left side 237. The lockouts 245 and 246 are elongate indentations and are preferably at the same height from the bottom 240. The lockouts 245 and 246 are generally parallel to each other and extend the length of the side. A vertical elongate lockout 247 is formed in the first side 236 and a second vertical lockout 248 is formed in the other side 237. The lockouts 247, 248 are generally elongate and are indentations formed in the sides, similar to the lockouts 245 and 246. The four lockouts generally have a ¼ radius in defining the size of the indentation. A first inwardly extending protruding lockout member 249 is secured to the lower side 206 and a similarly sized protruding lockout 250 is secured to the interior of the lower side 207. The protruding lockouts 249 and 250 are sized to be accommodated inside of the elongate lockouts 245 through 248. The lockouts 249 and 250 are in the shape of hemispheres. The lockouts are at a height from the bottom 208 such that when the bottom 240 of the bottle sits on the bottom section 208, the protruding lockouts 249 and 250 mate with the elongate lockouts 245 and 246. While the protrusions are hemispheres and the indentations have corresponding geometric shapes, it is understood that other geometric configurations may be used. However, the hemispheres provide for an easy transition when changing from the horizontal to the vertical direction as will be discussed more fully hereafter. While it is preferable to have two vertical lockouts and two horizontal lockouts, it is understood that one of each would also be operable.

There is also provided another lockout feature which matches the shape and configuration of the bottom section 208 to the shape and configuration of the bottom 240 and sides 236 and 237 of the bottle 201. In viewing FIG. 3, it can be seen that the radius 208*g* is sharper and closer to a 90° angle and the radius 208*f* is more rounded. The radius formed between the right side 236 and bottom 240, identified as 251 has a radius which matches that of 208*f*. The radius between the left side 237 and bottom 240, identified as 252, matches that of the radius 208*g*.

It can therefore be seen that the liquid dispenser 200 is designed to accept only a specific bottle 201, thereby insuring that the liquid concentrate being dispensed from dispenser 200 is always dispensed into the correct bottle 201. A second liquid concentrate is dispensed from a dispenser similar to dispenser 200. However, the bottle utilized in the second dispenser would have lockouts 245 and 246 at a different height as would be the corresponding protruding lockouts 249 and 250. The bottoms of the bottle of the second embodiment would be mirror images of the bottle 201. The bottom member of the second embodiment of the liquid dispenser would be a mirror image of bottom member 208. Therefore, the protruding lockouts would prevent the wrong bottle from being inserted as well as would the configuration of the bottom member 208 prevent the wrong bottles from being inserted into the dispenser 200. Therefore, there would be two lockouts to make certain that the right bottle is always filled with the correct liquid concentrate from the appropriate dispenser.

In use, the bottle 201, having elongate lockouts 245 and 246 would be slid into the liquid dispensing apparatus 200.

The protruding lockouts 249 and 250 would make certain that the correct bottle 201 is being inserted. Further, the size and configuration of the bottom member 208 also locks out a bottle that does not have the correct bottom shape and configuration. The bottle 201 is slid into the apparatus 200 along the elongate lockouts 245 and 246. Once the bottle 201 is fully inserted, the user then lifts up on the bottle and the protruding members 249 and 250 then guide the bottle as it is moved upwards and the protruding members 249 and 250 are positioned inside of the vertical elongate lockouts 247 and 248. The vertical alignment allows for the proper alignment of the bore 242*a* with the nozzle tip 229.

As the bottle 201 is being raised, it encounters the member 235*d*. When the slide actuator is in a first position (non-use) the switch 216*b* is fully extended and is under the second portion 235*b*. Then, as the slide actuator is moved to the second position (use), the inclined portion 235*c* contacts the button 216*b* and depresses it downward as the slide bracket travels in a direction substantially parallel to the longitudinal access. The motion of the switch 216*b* is in a direction substantially perpendicular to that of the movement of the bottle 201. It is important that the nozzle 229 be inside of the bottle when filling occurs. Therefore, it is important to coordinate the amount of travel of the incline section 235*c* necessary to activate the switch 216*b*. In the embodiment shown, the tip 229 is approximately 3/16" above the member 235*d*. Then, after an upward travel of approximately ½", the nozzle is inside of the bottle and finally ⅛" of additional travel activates the switch 216*b* at which time the nozzle tip is further into the bottle. Upon the depressible switch 216*b* being activated, the activation switch 216 allows the valve 210 to allow the diluent to enter the inlet 214. Water then exits through the outlet and out the tapered tip 229. As it exits, the diluent flows through the valve body, then draws liquid concentrate which is dispensed through the aspirator into the diluent to form a use solution which exits the nozzle into the bottle 201.

While the lockouts 245–248 have been described as indentations and the lockouts 249 and 250 as protruding or lugs, it is appreciated that the protruding lug may be placed on the bottle and the indentations (both horizontal and vertical) formed in the sides of the dispenser.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for diluting a liquid concentrate with a liquid diluent to form a dilute solution for dispensing into a bottle having a first lockout section and a second lockout section, comprising:

a) an aspirator having a liquid diluent inlet, an inlet for liquid concentrate and an outlet for a dilute solution;

b) a valve operably connected to the aspirator for controlling flow of liquid diluent from a source of liquid diluent to the aspirator inlet;

c) a base member positioned under the aspirator outlet, the base having first and second sides; and d) each side having a mating lockout member, the mating lockout member sized and configured to correspond with the first lockout section of the bottle and allowing generally horizontal movement of the bottle along the first lockout member and, when the bottle is fully inserted into the base member, allowing generally vertical movement along the second lockout section, wherein the lockout member, first lockout section and second lockout section prevent bottles having different lockout sections from entering the base member and providing alignment of the bottle as it is moved vertically toward the aspirator outlet.

2. The apparatus of claim 1, further comprising the first lockout section of the bottle is a first elongate indentation and the second lockout section is a second elongate indentation, generally perpendicular to the first indentation and the mating lockout member is an inwardly protruding lockout member, wherein the protruding lockout member slidable along the first indentation as the bottle is moved until the bottle is in a filling position and then the protruding lockout member is slidable in the second indentation.

3. An apparatus for diluting a liquid concentrate with a liquid diluent to form a dilute solution, comprising:

a) an aspirator having a liquid diluent inlet, an inlet for liquid concentrate and an outlet for a dilute solution;

b) a valve operably connected to the aspirator for controlling flow of liquid diluent from a source of liquid diluent to the aspirator inlet;

c) a bottle having an opening for receiving the dilute solution into its inner cavity, the bottle having a first lockout section and a second lockout section;

d) a base member positioned under the aspirator outlet, the base having first and second sides; and e) each side having a mating lockout member, the mating lockout member sized and configured to correspond with the first lockout section of the bottle and allowing generally horizontal movement of the bottle along the first lockout member and, when the bottle is fully inserted into the base member, allowing generally vertical movement along the second lockout section, wherein the lockout member, first lockout section and second lockout section prevent bottles having different lockout sections from entering the base member and providing alignment of the bottle as it is moved vertically toward the aspirator outlet.

4. The apparatus of claim 3, further comprising the first lockout section of the bottle is a first elongate indentation and the second lockout section is a second elongate indentation, generally perpendicular to the first indentation and the mating lockout member is an inwardly protruding lockout member, wherein the protruding lockout member slidable along the first indentation as the bottle is moved until the bottle is in a filling position and then the protruding lockout member is slidable in the second indentation.

5. The apparatus of claim 4, further comprising:

a) a bottom member having bottom section and first and second sides operatively connected to the first and second sides respectively of the base member;

b) the first side and bottom section forming a first geometric shaped opening and the second side and bottom section forming a second geometric shaped opening;

c) the bottle having a bottom section and first and second sidewalls; the bottom section and first sidewall forming a first geometric shape and the bottom section and second sidewall forming a second geometric shape, wherein the first geometric shaped opening matches the first geometric shape and the second geometric shaped opening matches the second geometric shape, thereby forming another lockout.

6. The apparatus of claim 5, further comprising the bottle having a closure for providing a spill free container for transport.

7. The apparatus of claim 6, wherein the closure forms a snap-fit with the opening of the bottle.

8. The apparatus of claim 7, further comprising a tether having a first end connected to the closure and a second end connected to the bottle.

9. The apparatus of claim 3, further comprising:

a) the valve having a control switch that is operable in a first direction;

b) a mounting bracket secured to the valve;

c) a slide member, movable in a second direction, positioned on the mounting bracket, the slide member having an inclined portion, wherein when in a first position the control switch is in a non-use position and when the slide moves to a second position, the inclined portion moves the control switch to a use position and causes the dilute solution to flow out the outlet.

10. The apparatus of claim 9, wherein the bottle opening contacts the first end of the slide member and the outlet enters the opening before the control switch is activated, thereby preventing spilling.

11. An apparatus for diluting a liquid concentrate with a liquid diluent to form a dilute solution, comprising:

a) an aspirator having a liquid diluent inlet, an inlet for liquid concentrate and an outlet for a dilute solution;

b) a valve operably connected to the aspirator for controlling flow of liquid diluent from a source of liquid diluent to the aspirator inlet;

c) a bottle having an opening for receiving the dilute solution into its inner cavity, the bottle having a first lockout section and a second lockout section;

d) a base member positioned under the aspirator outlet, the base having first and second sides;

e) each side having an interior protruding lockout member, the protruding lockout member sized and configured to correspond with the first lockout section of the bottle and allowing generally horizontal movement of the bottle along the first lockout member and, when the bottle is fully inserted into the base member, allowing generally vertical movement along the second lockout section, wherein the lockout member, first lockout section and second lockout section prevent bottles having different lockout sections from entering the base member and providing alignment of the bottle as it is moved vertically toward the aspirator outlet;

f) a bottom member having bottom section and first and second sides operatively connected to the first and second sides respectively of the base member;

g) the first side and bottom section forming a first geometric shaped opening and the second side and bottom section forming a second geometric shaped opening;

h) the bottle having a bottom section and first and second sidewalls; the bottom section and first sidewall forming a first geometric shape and the bottom section and second sidewall forming a second geometric shape, wherein the first geometric shaped opening matches the first geometric shape and the second geometric shaped opening matches the second geometric shape, thereby forming another lockout;

i) the valve having a control switch that is operable in a first direction;

j) a mounting bracket secured to the valve; and k) a slide member, movable in a second direction, positioned on the mounting bracket, the slide member having an inclined portion, wherein when in a first position the control switch is in a non-use position and when the slide moves to a second position, the inclined portion moves the control switch to a use position and causes the dilute solution to flow out the outlet.

12. A bottle for use with an apparatus for diluting a liquid concentrate with a liquid diluent to form a dilute solution for dispensing into the bottle, the apparatus having an aspirator having a liquid diluent inlet, an inlet for liquid concentrate and an outlet for a dilute solution; a valve operably connected to an aspirator for controlling flow of liquid diluent from a source of liquid diluent to the aspirator inlet; a base member positioned under the aspirator outlet, the base having first and second sides; and each side having a lockout member, the bottle comprising:

a) first and second sidewalls, front, back, top and bottom operatively connected to form a bottle having an inner cavity;

b) an opening formed in the top for receiving a dilute solution into the inner cavity;

c) a first lockout section on the first sidewall and a second lockout section, generally perpendicular to the first lockout section on the first sidewall, the first and second lockout sections sized and configured to correspond with the lockout member of the apparatus and allowing generally horizontal movement of the bottle along the first lockout section and, when the bottle is filly inserted into the base member, allowing generally vertical movement along the second lockout section, wherein the lockout member, first lockout section and second lockout section prevent bottles having different lockout sections from entering the base member and providing alignment of the bottle as it is moved vertically toward the aspirator outlet.

13. The bottle of claim 12, wherein the first lockout section is an elongate indentation and the second lockout section is an elongate indentation.

14. The apparatus of claim 13, further comprising the bottle having a closure for providing a spill free container for transport.

15. The apparatus of claim 14, wherein the closure forms a snap-fit with the opening of the bottle.

16. The apparatus of claim 15, further comprising a tether having a first end connected to the closure and a second end connected to the bottle.

* * * * *